US007284464B2

(12) United States Patent
Chaconas

(10) Patent No.: US 7,284,464 B2
(45) Date of Patent: Oct. 23, 2007

(54) OIL DRAIN PLUG WRENCH

(75) Inventor: Peter C. Chaconas, Glyndon, MD (US)

(73) Assignee: Easco Hand Tools, Inc., Simsbury, CT (US)

( * ) Notice: Subject to any disclaimer, the term of this patent is extended or adjusted under 35 U.S.C. 154(b) by 144 days.

(21) Appl. No.: 11/187,779

(22) Filed: Jul. 22, 2005

(65) Prior Publication Data

US 2007/0017322 A1 Jan. 25, 2007

(51) Int. Cl.
*B25B 13/46* (2006.01)
*B25B 13/00* (2006.01)

(52) U.S. Cl. ..... 81/63; 81/58; 81/58.1; 81/58.4; 81/124.4

(58) Field of Classification Search ..... 81/63, 81/124.4, 58.4, 58
See application file for complete search history.

(56) References Cited

U.S. PATENT DOCUMENTS

| | | | | | |
|---|---|---|---|---|---|
| 127,902 | A | | 6/1872 | Leonard | |
| 161,022 | A | | 3/1875 | Freeman | |
| 272,822 | A | * | 2/1883 | Womelsdorff | 81/60 |
| 1,191,873 | A | | 7/1916 | Cressey et al. | |
| 3,349,653 | A | | 10/1967 | Kaufman et al. | |
| 3,709,073 | A | | 1/1973 | Kurtz | 81/119 |
| 3,838,614 | A | | 10/1974 | O'Donnell | |
| 3,875,828 | A | | 4/1975 | Evans | |
| 4,663,998 | A | * | 5/1987 | Parsons et al. | 81/125 |
| 4,770,071 | A | | 9/1988 | Steier | |
| 4,796,492 | A | * | 1/1989 | Liou | 81/58 |
| 4,800,786 | A | | 1/1989 | Arnold et al. | 81/121.1 |
| 4,807,500 | A | | 2/1989 | Main | |
| 4,825,732 | A | | 5/1989 | Arnold | 81/121.1 |
| 4,836,059 | A | | 6/1989 | Arnold | 76/114 |
| 4,889,020 | A | | 12/1989 | Baker | |
| 4,991,468 | A | | 2/1991 | Lee | |
| 5,197,358 | A | | 3/1993 | Hsu | |
| 5,277,088 | A | * | 1/1994 | Vasichek et al. | 81/125 |
| 5,454,283 | A | | 10/1995 | Stefano | |
| 5,467,672 | A | | 11/1995 | Ashby | |
| 5,647,252 | A | * | 7/1997 | Miner | 81/62 |
| 5,653,151 | A | | 8/1997 | Blacklock | 81/60 |
| 5,709,137 | A | | 1/1998 | Blacklock | 81/60 |
| 5,842,391 | A | * | 12/1998 | Chaconas | 81/60 |
| 6,688,195 | B1 | * | 2/2004 | Hsien | 81/60 |
| 6,918,323 | B2 | | 7/2005 | Arnold et al. | 81/63.2 |
| 7,051,623 | B2 | * | 5/2006 | Chaconas | 81/60 |
| 7,159,491 | B1 | * | 1/2007 | Chaconas et al. | 81/58.1 |
| 2004/0093995 | A1 | * | 5/2004 | Hu | 81/63.2 |

* cited by examiner

*Primary Examiner*—Boyer D. Ashley
*Assistant Examiner*—Bryan R. Muller
(74) *Attorney, Agent, or Firm*—Nelson Mullins Riley & Scarborough, L.L.P.

(57) ABSTRACT

An oil drain plug wrench is provided to enable a user to more easily remove and install an oil drain plug. The wrench includes a rotor with two cavities on opposite sides of a rotor. When either of the cavities engages a workpiece, the wrench is capable of applying torque to the workpiece in a first rotational direction and ratcheting in a second rotational direction. A flange is provided on the outer diameter of the rotor to allow a user to remove or install an oil drain plug by hand.

6 Claims, 10 Drawing Sheets

OIL DRAIN PLUG WRENCH

BACKGROUND OF THE INVENTION

The present invention relates generally to ratcheting tools, and more particularly to a ratchet wrench that allows a user to easily remove an oil drain plug.

Changing the oil in a motorized vehicle requires removal of the oil drain plug so old oil can drain from the oil pan into a collection tank. In the case of businesses that specialize in fast oil change service, the oil is drained from the engine while it is still hot so that contaminants and impurities are carried out with the hot oil before having a chance to settle and cling to the bottom of the oil pan as the oil cools. Since the oil is hot, the oil plug is can be hot to the touch, making it difficult to remove. Once the oil is drained, the oil drain plug is replaced and new oil is added to the engine through an oil fill port.

Previously, the oil drain plug was removed using a variety of tools, such as an open end wrench, a fixed box end wrench, pliers, a ratcheting socket wrench or a ratcheting box end wrench. However, each tool is problematic. For example, open ends and fixed box end wrenches are slow because of the need to mount and dismount the wrench on the oil drain plug each time the wrench is indexed. Ratcheting wrenches are problematic because once the oil drain plug is broken loose, there is not enough friction between the threads of the oil drain pan and the oil plug to allow the wrench to ratchet. In any case, to quicken the process, once the drain plug is loosed the operator will usually remove the wrench and further remove the drain plug by hand.

SUMMARY

The present invention recognizes and addresses considerations of prior art constructions and methods and provides an oil drain plug wrench that allows a user to easily remove or install an oil drain plug.

In one embodiment of the present invention, a wrench has a handle, a head connected to the handle, a generally cylindrical rotor, and at least one tooth formed in a bore in the head of the wrench. The head is comprised of a top surface and a bottom surface, and the bore has a first radius that defines an inner circumferential surface.

The generally cylindrical rotor is partially received within the bore, and has a plurality of spaced-apart rotor teeth formed axially on an outer circumference thereof. The rotor also has a first portion and a second portion. The first portion defines a second radius and a first cavity, and the second portion defines a third radius that is larger than both the first and second radii, and a second cavity. The cavities are configured to engage a workpiece and are separated by a web. The first portion is received within the generally cylindrical head bore, and the second portion is adjacent to the wrench head top surface.

At least one tooth is formed on the bore's inner circumferential surface that projects radially inward. The at least one bore tooth has a first surface and a second surface, each surface having a height. The plurality of spaced-apart rotor teeth are configured to engage the at least one bore tooth.

Movement of the head in a first rotational direction engages the at least one bore tooth with at least one of the plurality of rotor teeth, thereby transmitting torque to the workpiece.

Movement of the head in a second opposite rotational direction allows the plurality of rotor teeth to ratchet over the at least one bore tooth.

The accompanying drawings, incorporated in and constituting part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
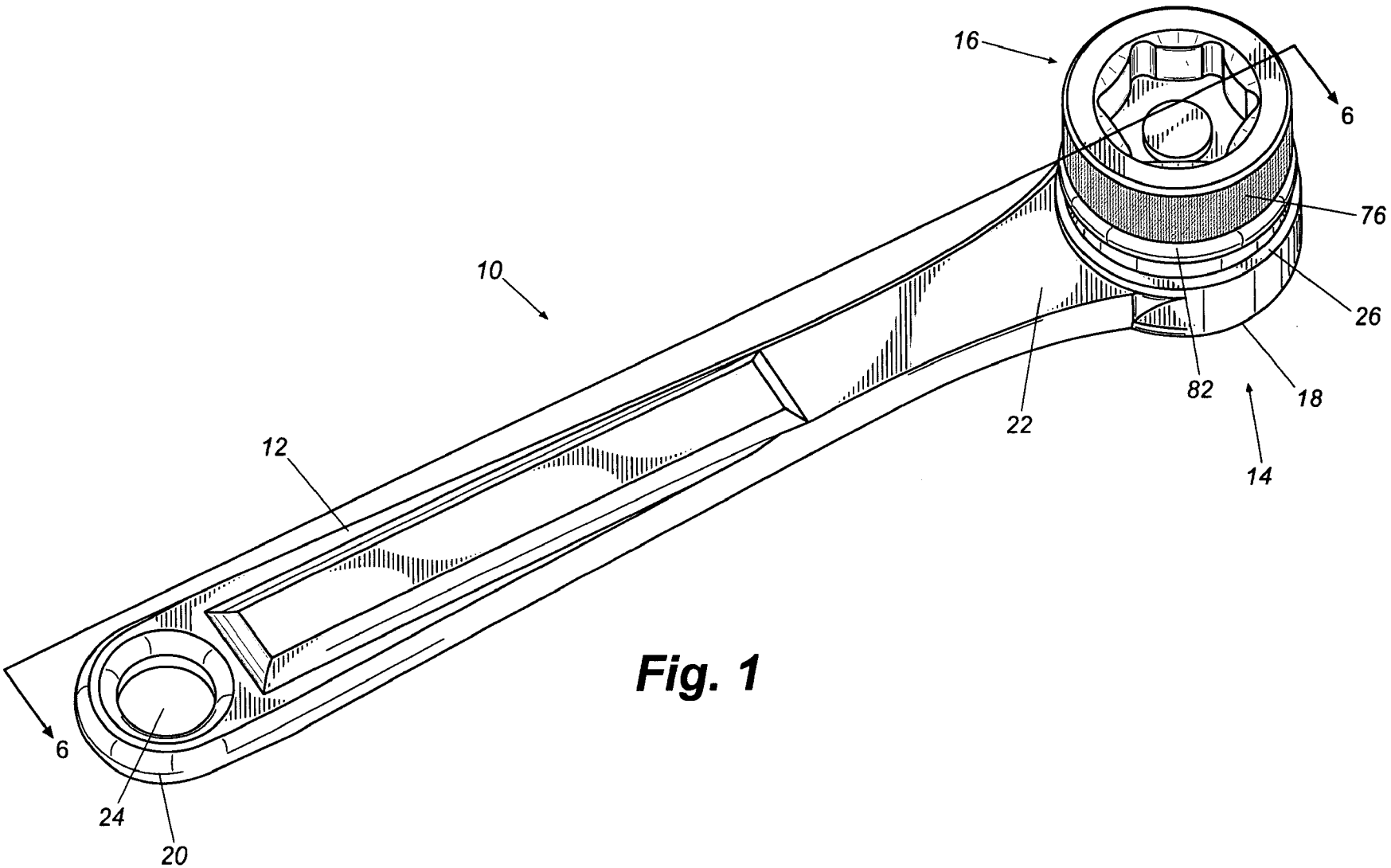
FIG. 1 is a perspective view of a wrench in accordance with an embodiment of the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
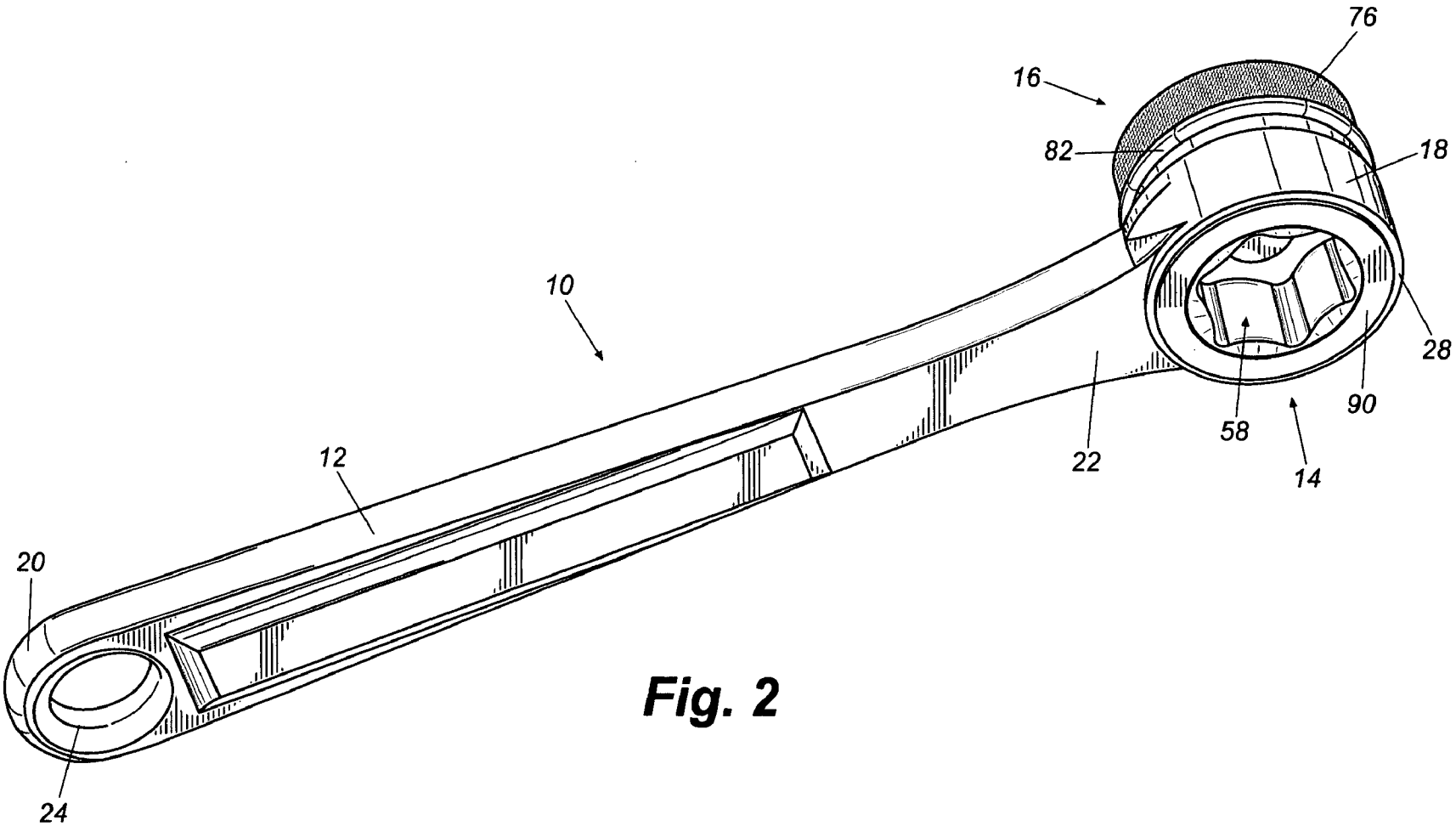
FIG. 2 is a perspective view of the opposite side of the wrench shown in FIG. 1.
Figure 3:
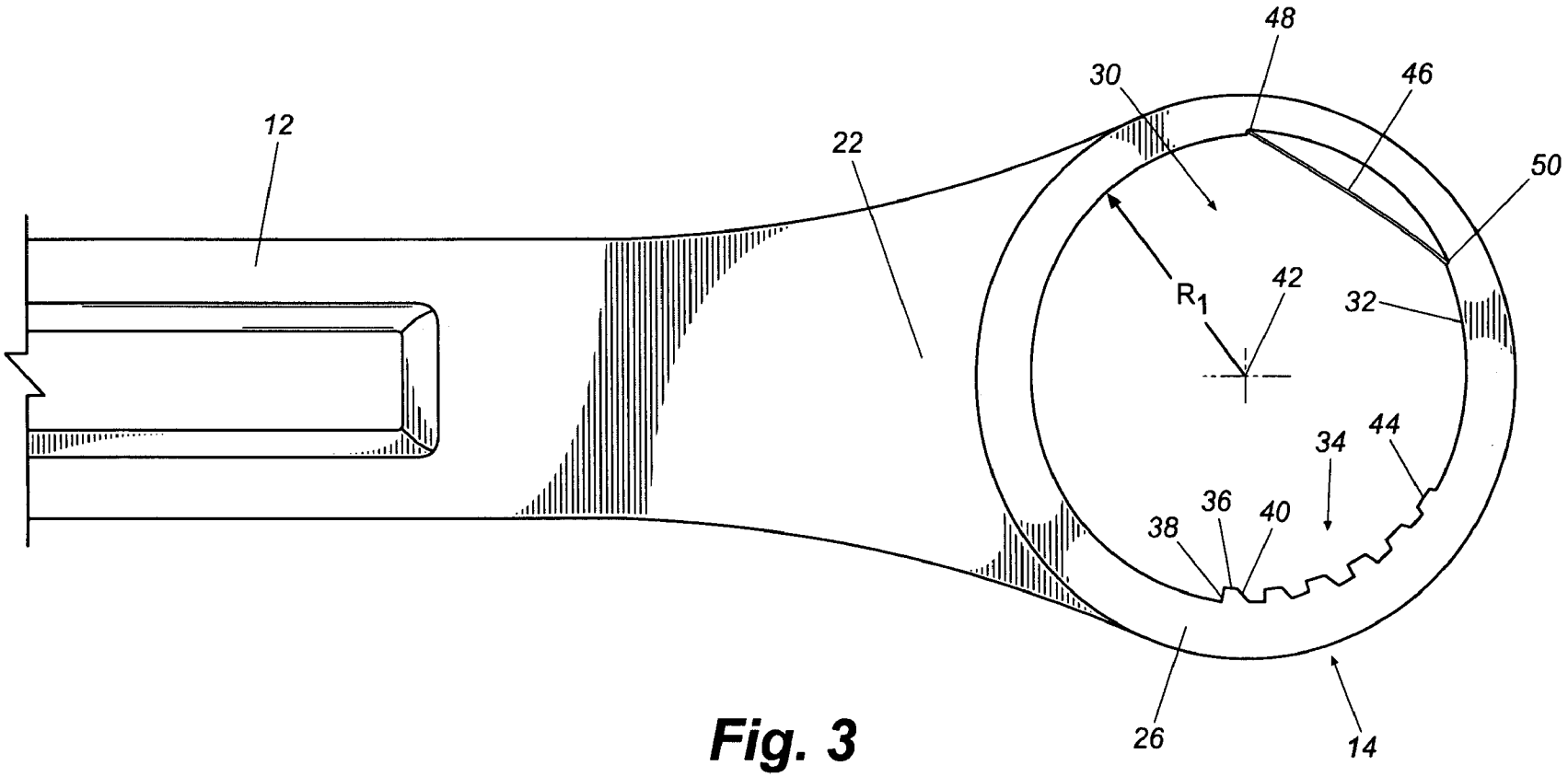
FIG. 3 is a bottom plan view of the wrench shown in FIG. 1 with the rotor removed.

Referring to the drawings, and particularly to FIGS. 1, 2 and 3, a wrench 10 has a body with a handle 12, a head 14 and a rotor 16. The body and rotor may be formed from any suitable material, for example one or a combination of steel, alloy, ceramics, polymers, etc. A first end 18 defines head 14, and a second end 20 defines handle 12. Head 14 is integrally formed with handle 12 by a neck 22, and second end 20 has a bore 24 formed therethrough that allows for easy storage of wrench 10 when not in use. Instead of bore 24, other means of storing wrench 10 may be provided.

Head 14 has a top surface 26 (FIG. 1) and a bottom surface 28 (FIG. 2) located on opposite lateral sides of the wrench. Referring particularly to FIG. 3, head 14 defines a bore 30 that extends between top surface 26 and bottom surface 28, generally is defined over a first radius R1, and is bounded by an inner circumferential surface 32. A series of bore teeth 34 are formed on a portion of inner circumferential surface 32. With reference to a first bore tooth 36, each bore tooth has a first surface 38 that extends substantially parallel to a plane that intersects a center 42 of bore 30 and a second surface 40 that is angled with respect to the plane.

Bore teeth 34 are arranged sequentially on inner circumferential surface 32 from first tooth 36 to a last tooth 44. The height of the last tooth's first surface is about one-half of the height of the first tooth's first surface, and the intermediate teeth decrease in first surface height proportionately from first tooth 36 to last tooth 44.

A leaf spring 46 is mounted in notch ends 48 and 50 formed in bore inner circumferential surface 32. In one embodiment, leaf spring 46 is formed from 1070 or 1095 spring steel. However, it should be understood that other suitable materials may be used, such as metal alloys, polymers, etc. Because bore 30 is generally cylindrical, bore teeth 34 and leaf spring 46 may be located in other positions relative to web 22 so long as leaf spring 46 urges the rotor teeth into engagement with the bore teeth, as described below and shown in FIG. 7. U.S. Pat. No. 5,842,391 to Chaconas discloses examples of pawless wrenches that have the head bore teeth located at different positions within the bore and is incorporated by reference herein in its entirety. While the present invention may also include embodiments having only a single bore tooth, a plurality of bore teeth increases the torque loading of the wrench.

Figure 4:
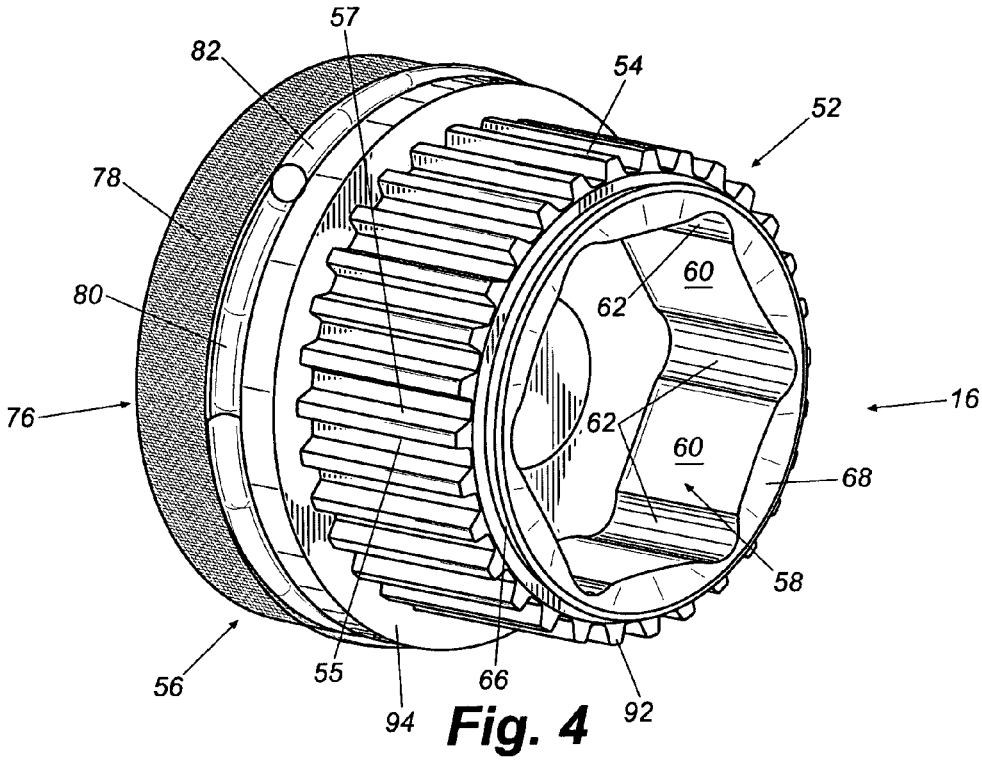
FIG. 4 is a perspective view of a rotor.
Figure 5:
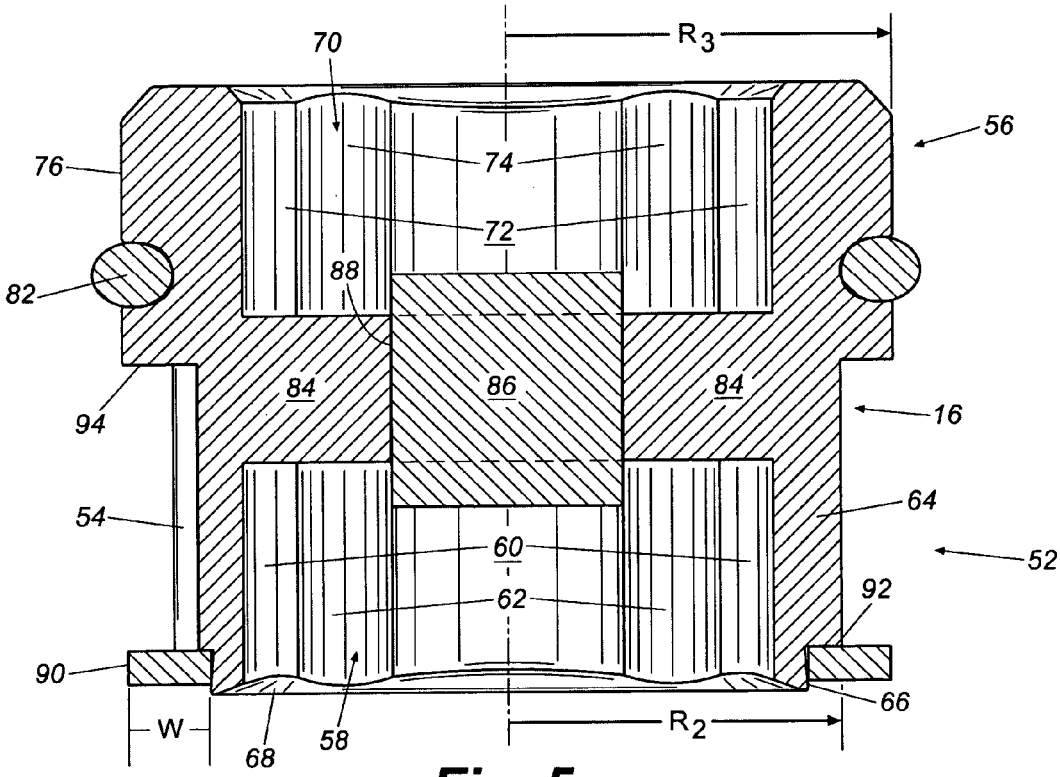
FIG. 5 is side elevation cut-away view of the rotor shown in FIG. 4.
Figure 7:
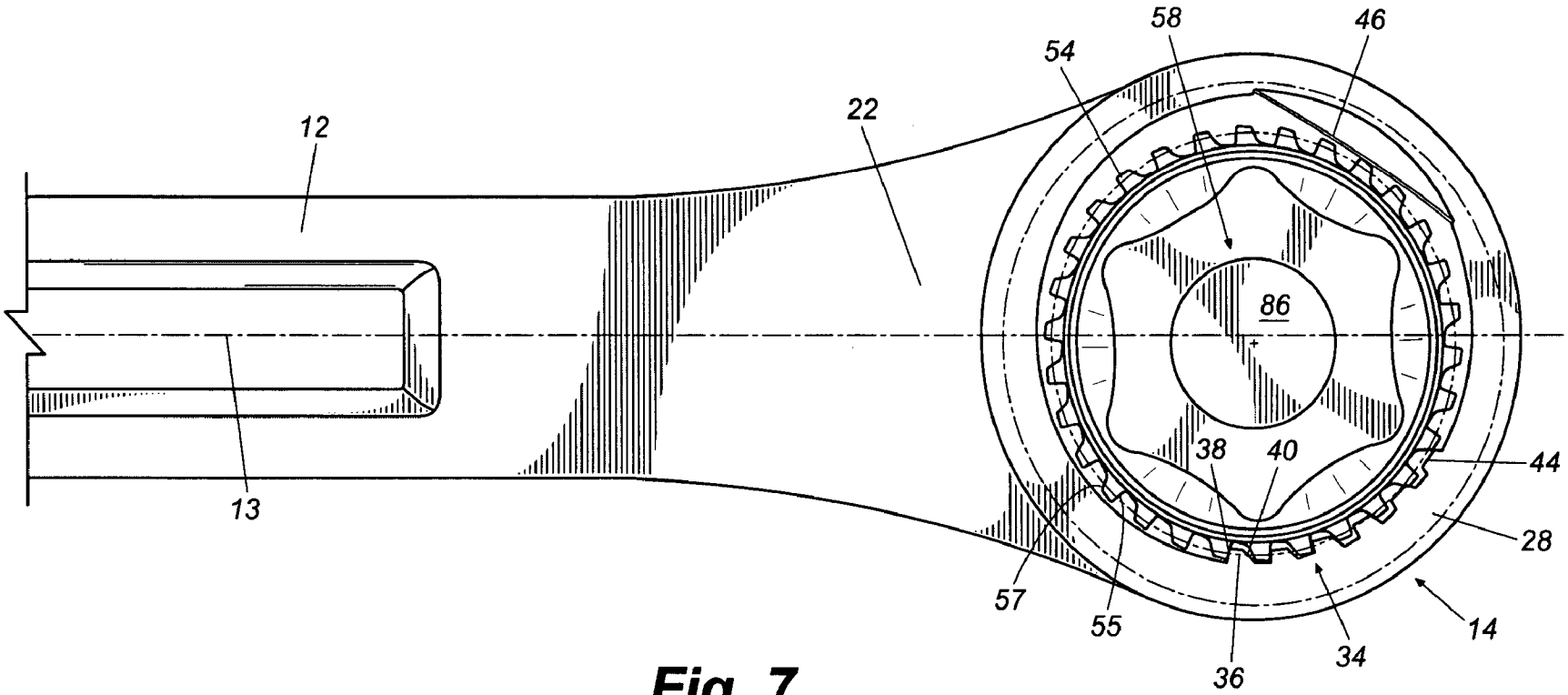
FIG. 7 is a bottom plan view of the wrench shown in FIG. 1 with the washer removed.

Referring to FIGS. 4 and 5, rotor 16 has a first portion 52 defined over a second radius R2 and a second portion 56 defined over a third radius R3 that is larger than radius R2. First portion 52 has rotor teeth 54 that are axially aligned with the rotor's centerline on the rotor's outer circumferential surface and interengage with bore teeth 34. Each rotor tooth has a first surface 55 that extends generally parallel to the plane that intersects center 42 (FIG. 3) and a second surface 57 that is slightly angled with respect to the plane to assist in ratcheting. The shape and size of rotor teeth 54 closely resemble the shape and size of bore teeth 34 such that bore teeth 34 interengage with rotor teeth 54, as shown in FIG. 7.

First portion 52 further defines a first cavity 58 therein that is configured to engage a workpiece. In the embodiment shown in FIG. 4, first cavity 58 has a hexagonally shaped cross-section and is formed from a series of substantially planar surfaces 60 separated by curved portions 62, which prevent the rounding of workpiece corners during torquing. A wall 64 is included between first cavity 58 and the first portion outer circumference and is sized to maintain proper strength qualities for a desired application. Referring specifically to FIG. 5, a lip 66 is formed about the outer edge of first portion 52 adjacent an edge 92 of rotor teeth 54. A tapered portion 68 facilitates positioning of first cavity 58 on a workpiece (not shown).

Second portion 56 further defines a second cavity 70 that also is hexagonally shaped and formed from a series of substantially planar surfaces 72 separated by curved portions 74.

While first cavity 58 and second cavity 70 could be configured to engage different-sized workpieces, in the embodiment shown in the figures, the cavities are sized to engage a similarly-sized workpiece. The advantage of having two similarly-sized cavities in a nonreversible ratcheting wrench is that one side may be used to tighten a workpiece and the other side to loosen the workpiece.

Second portion 56 includes a flange 76 having a frictional outer edge surface 78. The flange may be formed from any number of materials, and may be a ring press-fitted to the outer circumference of second portion 56 or may be integrally formed with the rotor. Frictional outer edge surface 78 in the figures is shown as a knurled surface designed to facilitate a user's rotation of rotor 16 by hand. Other suitable frictional surfaces, such as an elastomeric surface, could be used instead of the knurled surface. Flange 76 is also referred to as a "speed ring" because it allows a user to quickly spin rotor 16 without moving handle 12. Use of the speed ring is particularly advantageous once a threaded workpiece has been broken loose and only a low amount of torque is necessary to rotate the workpiece. The same would be true when the workpiece is initially threaded during installation of the workpiece. Thus, while the amount of torque the user is able to impart to a workpiece is reduced when using flange 76, a higher number of rotations of rotor 16 may be accomplished in a shorter time. Second portion 56 also includes a groove 80 that receives an O-ring 82. O-ring 82 is preferably formed of an elastomer or other polymeric material and may be made in different colors to assist in the identification of different size wrenches.

Referring to FIG. 5, rotor 16 includes a web 84 between first cavity 58 and second cavity 70. A bore 88 formed through web 84 receives a magnet 86 that retains a workpiece within one or both of the cavities. Magnet 86 may be of any suitable shape material, and in one embodiment, magnet 86 is generally cylindrical in shape, formed from rare earth material and is press-fitted into bore 88. It should be understood that magnet 86 may be formed from two magnets one mounted in first cavity 58 and the other mounted in second cavity 70 proximate web 84, and may also be formed from other suitable materials, such as ferrite.

Figure 6:
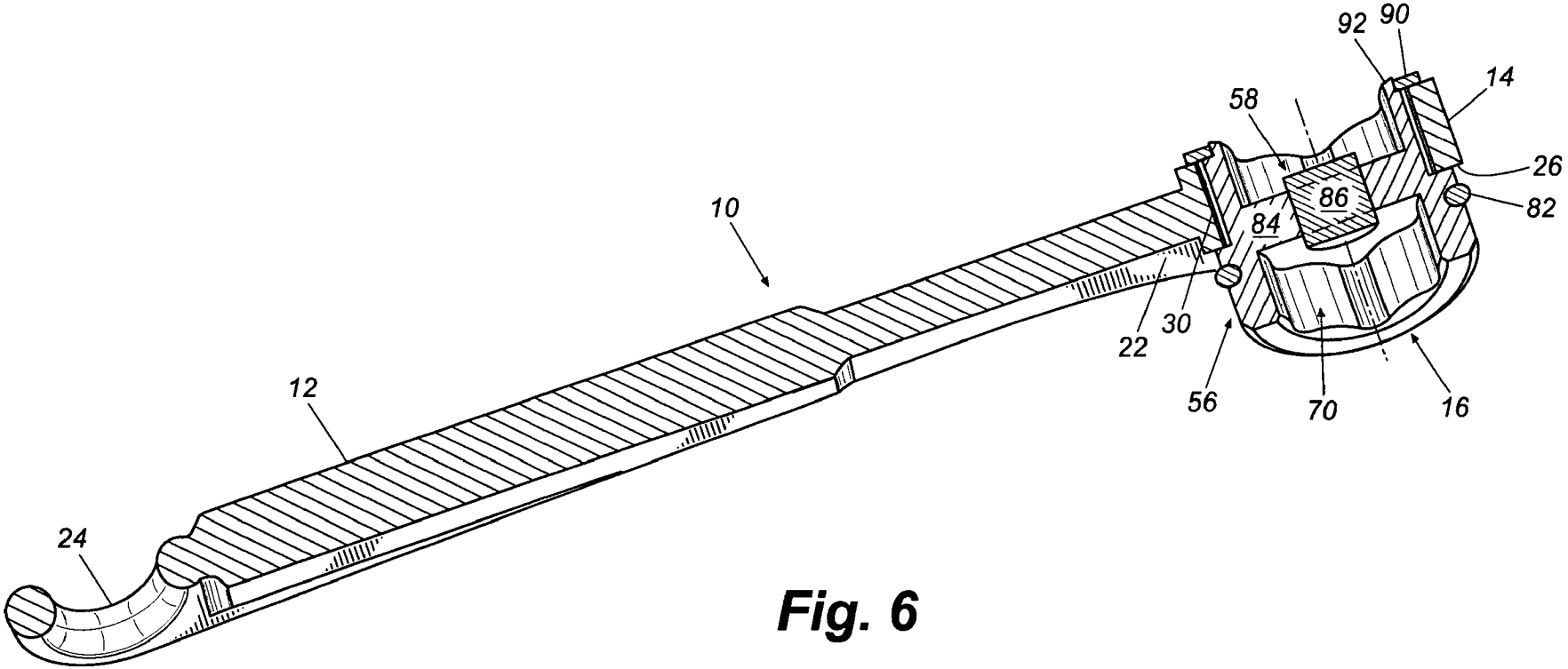
FIG. 6 is a cut-away perspective view of the wrench shown in FIG. 1 through line 6-6.

Referring to FIG. 6, rotor 16 is partially received within head bore 30. Because bore radius R1 is slightly greater than first portion radius R2, there is sufficient free play between rotor 16 and inner circumferential surface 32 to allow the rotor teeth to ratchet over the bore teeth. Preferably, the amount of free play is no more than 25 thousandths of an inch in any direction, but the clearance may be larger or smaller depending on the shape and size of the bore teeth and rotor teeth.

A circular washer 90, having a width W, abuts rotor teeth end 92 and surrounds lip 66 (FIG. 5). Washer width W is selected so that the washer substantially seals the interior of bore 30 from the outside, thereby preventing debris from interfering with the operation of the rotor and bore teeth. In the embodiment shown in FIGS. 2 and 6, the outer diameter of washer 90 is approximately equal to second rotor portion radius R3. Once first portion 52 is inserted into head bore 30, and washer 90 is fitted about lip 66, a circular staking operation is performed upon lip 66 to secure washer 90 on rotor 16 and against bottom surface 28 so that the rotor is secured within head bore 30. When the rotor is installed in the head bore, a shoulder 94 (FIG. 4 and 5) abuts head top surface 26. Since radius R3 is larger than radius R2, rotor second portion 56 is sufficiently large to cover the opening created by head bore 30. Otherwise, debris could enter between second portion 52 and head bore 30, thereby negatively affecting the performance of the wrench.

As previously discussed, bore teeth 34 decrease in height from first tooth 36 to last tooth 44. The decreasing bore tooth height allows the rotor teeth to ratchet over the bore teeth with reduced radial translation of the rotor in the head bore. Consequently, reduction in clearance between the bore teeth and the rotor teeth results in (1) less play between the rotor and head as the tool is being ratcheted since the overall diameter of the head bore can be reduced and (2) a smaller head design since the size of the head bore can be reduced. Furthermore, the design of the rotor teeth and bore teeth are selected to maximize the torque of the wrench while ensuring that the two sets of teeth will ratchet smoothly with respect to one another when desired. For example, the spacing between the bore teeth and rotor teeth are selected by balancing the manufacturing costs of milling a higher number of teeth (the cost rises as the number of teeth increase) with performance characteristics, for example a larger number of rotor teeth and bore teeth enable the user to ratchet wrench 10 with a smaller index angle of handle 12.

The operation of wrench 10 will now be described with reference to FIGS. 7 and 8. Referring first to FIG. 7, leaf spring 46 urges rotor teeth 54 into engagement with head bore teeth 34. In this position and with rotor cavity 70 mounted on a workpiece, clockwise rotation of handle 12 causes the rotor teeth to contact a portion of inner circumference 32 proximate web 22, which rotates bore teeth first surfaces 38 into contact with rotor teeth first surfaces 55. Thus, as the wrench is rotated clockwise, the load applied by handle 12 will be distributed over the surface area of contact between the bore and rotor teeth, thereby imparting rotation to the workpiece in the clockwise direction, i.e. the tightening direction. If space constraints placed upon the user of the wrench are such that handle 12 cannot be easily rotated about the workpiece, the user may cease clockwise rotation of handle 12 and rotate rotor 16 using speed ring 76 until the workpiece cannot be further rotated by hand. At this point, the user can further tighten the workpiece by rotating handle 12 in the clockwise direction. Once a full swing of handle 12 is reached, the handle is rotated in the opposite counterclockwise direction so that rotor teeth 54 ratchet over bore teeth 34, as described below.

Figure 8:
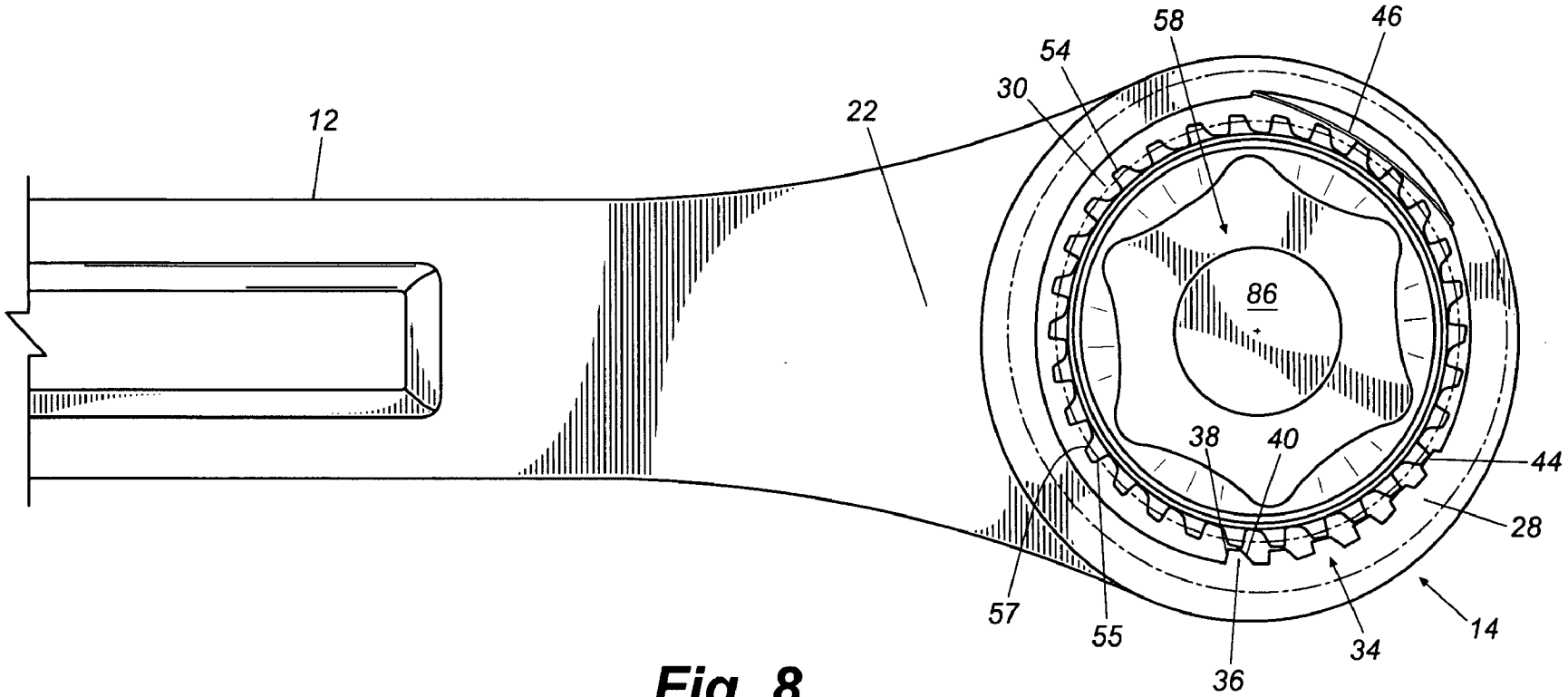
FIG. 8 is a bottom plan view of the wrench shown in FIG. 1 with the rotor teeth ratcheting over the bore teeth.

Referring now to FIG. 8, generally cylindrical rotor 16 is shown in a ratcheting position. That is, as handle 12 is rotated counterclockwise, bore teeth surfaces 40 bear against rotor teeth second surfaces 57 so that the angle of both surfaces cause the rotor teeth to slide up and ride over the bore teeth. This ratcheting effect between the teeth allows head 14 to rotate with respect to rotor 16. As the ratcheting occurs, leaf spring 46 bows radially outward, creating a reaction force that presses rotor 16 toward bore teeth 34. Thus, if a user were to change direction and once again rotate handle 12 clockwise, leaf spring 46 would urge rotor teeth 54 into engagement with bore teeth 34 so that the workpiece can be further tightened.

To loosen or remove a workpiece (assuming the workpiece is right hand threaded), the user rotates the wrench about an axis 13 (FIG. 7) of handle 12 such that rotor cavity 58 can engage the workpiece. In this position, cavity 58 can mount on the workpiece, and the user can rotate the handle counterclockwise to loosen the workpiece. Optionally, once the user breaks the workpiece loose, speed ring 76 can be gripped by hand and rotated counterclockwise to remove the workpiece without swinging handle 12. As discussed previously, it may prove to be more convenient to use speed ring 76 to rotate the workpiece once the workpiece has been loosened. If the handle is rotated in the opposite clockwise direction, the rotor teeth will ratchet over the head bore teeth so that the head rotates with respect to the rotor.

Figure 11:
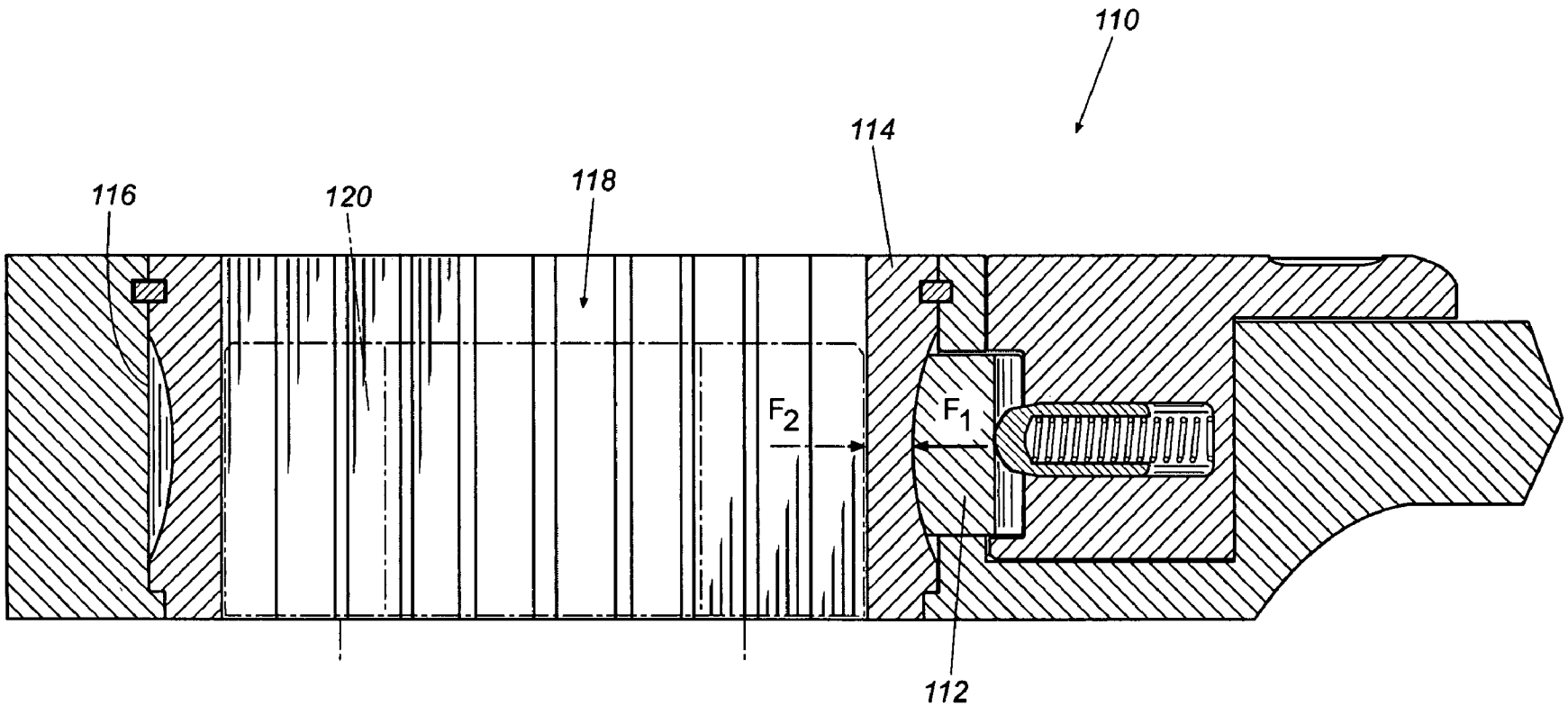
(Prior Art) Fig. 11
FIG. 11 is a cut away of a prior art wrench.

Referring to FIG. 11, in a prior art ratcheting wrench 110 having a pawl 112, a rotor 114 is substantially received in a head bore 116, and a single cavity 118 is formed through rotor 114. During operation of the wrench, pawl 112 imparts a radially inward directed force $F_1$ against rotor 114, and a fastener head 120 within cavity 118 imparts a radially outward directed force $F_2$. Because the radially inward and radially outward forces are substantially equal and exerted substantially over the same surface area of the rotor, the rotor does not effectively deform during torque loading. However, if the rotor design of the present invention is included in either a reversible or non reversible ratcheting wrench, then radially inward directed force $F_1$ and radially outward directed force $F_2$ may be offset from each other, and deformation of the rotor may occur during torque loading.

Figure 9:
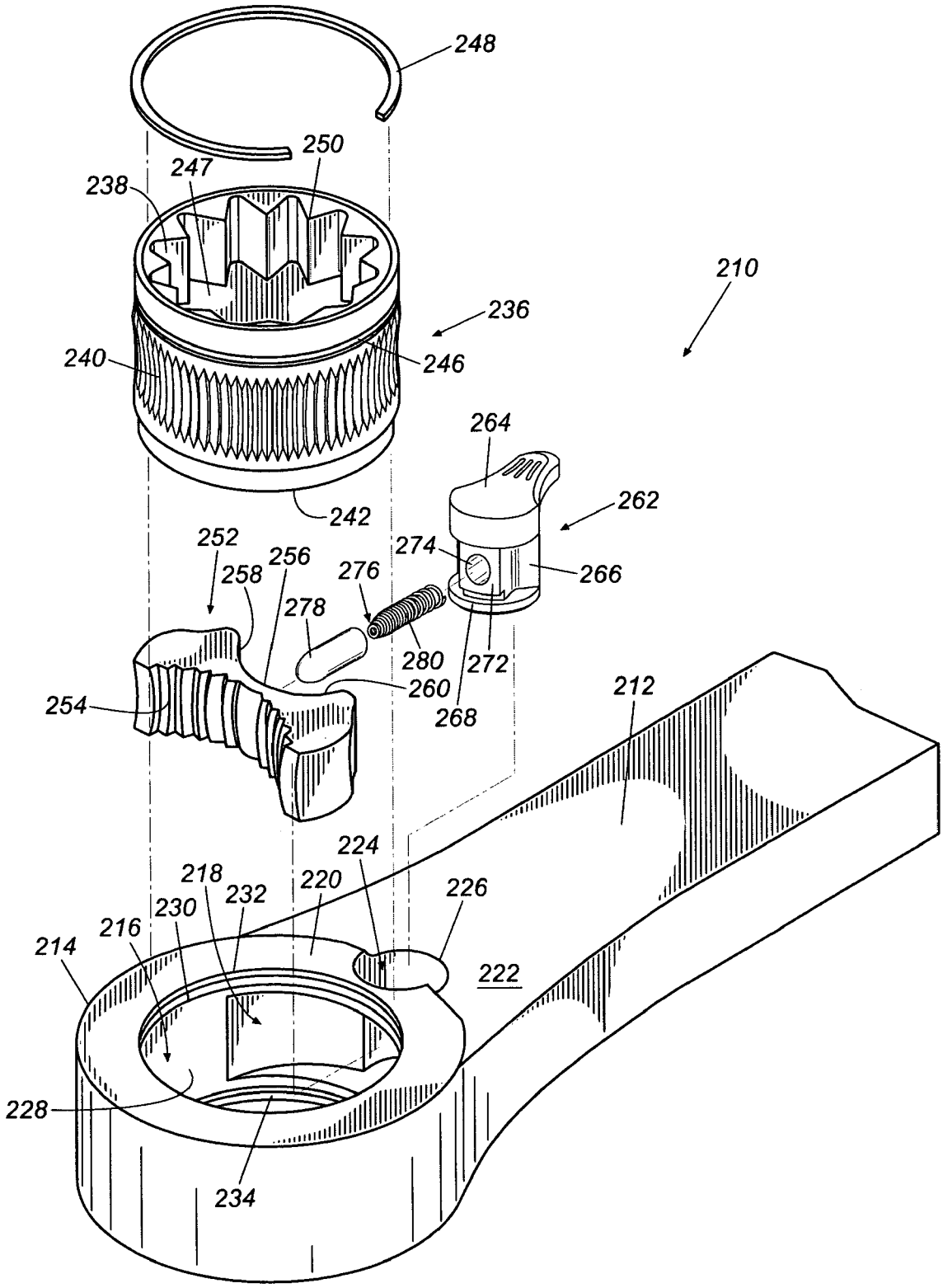
FIG. 9 is a exploded perspective view of a wrench in accordance with an embodiment of the present invention.
Figure 10:
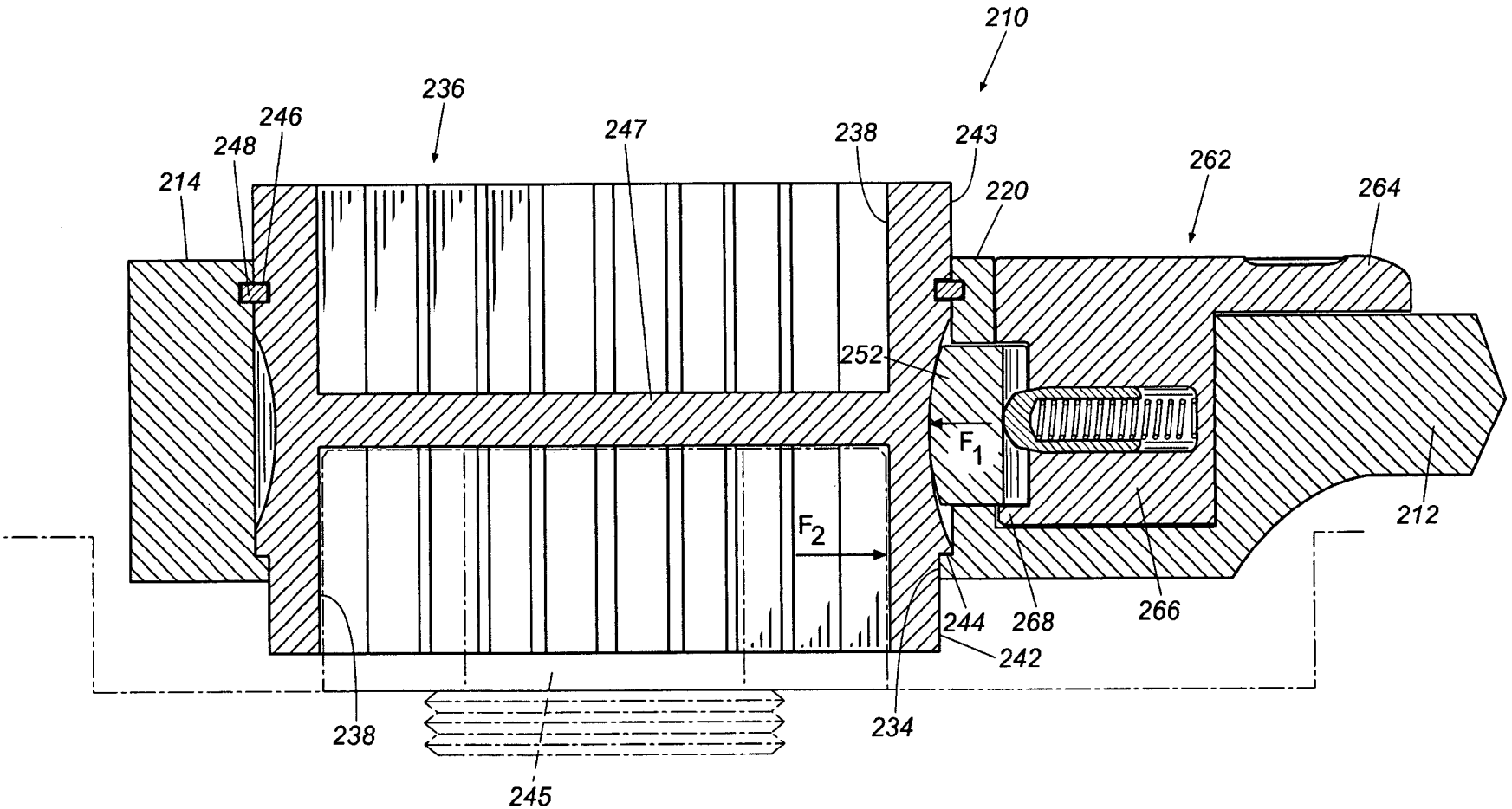
FIG. 10 is a cut away view of the wrench shown in FIG. 9.

For example, referring to FIGS. 9 and 10, a ratcheting tool 210 includes a body with a handle 212 and a head 214 extending from the handle. The head and handle may be integrally formed from a material capable of withstanding high shear forces, for example stainless steel and metal alloys, ceramics, or polymers. Handle 212 may be a solid piece, and the shape and length of handle 212 may vary depending on the application of ratcheting tool 210; for example, handle 212 may be generally cylindrical or polygonal in cross-section along the longitudinal axis of the handle.

Referring particularly to FIG. 9, head 214 defines a relatively large and generally cylindrical through-hole compartment 216. A smaller, wedge-shaped compartment 218 is defined in a web portion 220 intermediate head 214 and handle 212. A generally cylindrical compartment 224 extends through face 222 into web 220 at a hole 226 and is in communication with compartment 218. Compartment 218 is closed above and below and is in communication with compartments 216 and 224. Compartments 216 and 224 are cylindrical in shape, and compartment 218 is generally wedge shaped with curved side walls. A wall 228 defining compartment 216 defines an annular groove 230 proximate its top edge 232 and a flat annular inward extending ledge 234 proximate its bottom edge.

Compartment 216 receives an annular rotor 236 having an inner surface 238 that is concentric with wall 228. Inner surface 238 of rotor 236 defines a plurality of aligned keys 250 spaced equiangularly about inner surface 238. Keys 250 extend radially into compartment 216 and are spaced to engage the sides of a bolt, nut, or other work piece. The outer circumference of rotor 236 defines a series of vertically-aligned teeth 240. Teeth 240 curve inward at their center so that the rotor's outer surface defines a concave shape. A bottom side of rotor 236 defines an extension portion 242 surrounded by a flat annular shoulder 244 (FIG. 10). Extension portion 242 fits through ledge 234 so that shoulder 244 sits on ledge 234, thereby retaining rotor 236 in the lower axial direction while permitting the rotor to rotate with respect to the head. A top end 243 (FIG. 10) of rotor 236 and extension 242 protrude out from head 214 to allow for loosening or tightening of a recessed fastener 245 as shown in FIG. 10. Extension portion 242 and top end 243 may be knurled on the outer circumference to allow a user to easily rotate the rotor by hand. A web 247 is formed across rotor inner surface 238. As described below, web 247 provides structural stability to rotor 236.

Rotor 236 defines an annular groove 246 about its outer surface proximate its upper end. A C-ring 248 is received in groove 246, and an outer surface of the ring normally extends slightly outward of the groove. As rotor 236 is inserted into compartment 216, C-ring 248 compresses into groove 246 until groove 246 aligns with annular groove 230 (FIG. 9) in the upper edge of wall 228. C-ring 248 then expands into groove 230, thereby securing rotor 236 in the upper axial direction.

Referring to FIG. 9, a generally wedge-shaped pawl 252 is received in compartment 218 so that the top and bottom surfaces of compartment 218 retain the pawl from above and below. Sufficient clearance is provided between those surfaces and the pawl, however, so that the pawl may easily slide from side to side. Pawl 252 defines a plurality of vertically-aligned teeth 254 in an arc across the pawl's front face that matches the arc of the outer perimeter of rotor 236. In the vertical direction, teeth 254 curve outward in a convex shape that corresponds to the concave outer surface of rotor 236. The back end of pawl 252 defines a recessed portion 256 consisting of an arc having symmetrical sides 258 and 260. It should be understood that the arc of the pawl teeth across the face of the pawl may be defined over a radius that is larger than the radius of the arc of the gear teeth, as described and shown in U.S. patent application Publication No. 2004/0083860 entitled Reversible Ratcheting Tool With Improved Pawl, filed Nov. 1, 2002, the disclosure being incorporated by reference herein in its entirety.

A switch lever 262 includes a handle 264 and a bottom portion 266 that extends below the handle. A front face 272 defines a blind bore 274 sized and shaped to receive a detent 276. Detent 276 includes a pin 278 and a spring 280 formed from any suitable resilient material, in one embodiment stainless steel.

As shown in FIG. 10, hole 226 defined in top surface 222 receives bottom portion 266 of lever 262. The outer diameter of bottom portion 266 is approximately equal to the inner diameter of hole 226, although sufficient clearance is provided so that switch lever 262 rotates easily in the hole. In the embodiment shown in FIGS. 9 and 10, a lip 268 of lever 262 is received under pawl 252 to retain the lever in the wrench head. However, lever 262 may be secured in wrench 210 in various other ways. For example, the outer surface of bottom portion 266 may define an annular groove (not shown) that receives an O-ring (not shown). Upon insertion of bottom portion 266 into hole 226, the O-ring is initially pushed radially inward into the groove. When the groove aligns with an annular groove (not shown) defined about the inner circumference of hole 226, an outer portion of the O-ring extends into the groove, thereby axially securing switch lever 262 in web 220. A C-clip (not shown) may also be used in place of the O-ring in securing lever 262 in compartment 224. Other methods for securing lever 262 should be understood to be within the scope of the present invention.

In operation, when the rotor is secured onto recessed fastener head 245, the fastener head is received in a cavity defined in the rotor axially below a center of pawl 252 with respect to an axis perpendicular to web 247. That is, an outward force $F_2$ exerted by the fastener head onto the rotor wall is offset from an inward force $F_1$ exerted by the pawl onto the rotor wall. Thus, when operating on a recessed fastener or a fastener that cannot be fully received in the rotor cavity, force $F_1$ will not align with force $F_2$ causing potential damaging deformation of the rotor. To account for the misalignment, rotor web 247 is located proximate the portion of the rotor wall subjected to force $F_1$ and provides structural stability to the rotor walls against the crushing force $F_1$ and expansion force $F_2$. As a result, web 247 increases the torque loading that can be applied by a user on wrench 210.

It should also be understood that the rotor web can also be used in ratcheting wrenches where one or both rotor ends are located substantially within the wrench head bore or one or both rotor ends are substantially located outside the wrench head bore. Therefore, the thickness of the rotor web may vary depending on the application and design of the rotor, i.e. a thicker web for rotors with longer axial lengths and a thinner web for rotors with shorter axial lengths. Moreover, the web may be formed with or without an axial bore therethrough for retaining a magnet.

Wrench 210 differs from wrench 10 in that it is a reversible ratcheting wrench. That is, the wrench can be engaged on a workpiece and torque can be applied in a first direction while ratcheting occurs in a second direction. To apply torque in the second direction and ratchet in the first direction, the user merely switches level 262. Detailed operation of wrench 210 is illustrated and disclosed in U.S. patent Publication No. 2004/0083860.

While one or more preferred embodiments of the invention have been described above, it should be understood that any and all equivalent realizations of the present invention are included within the scope and spirit thereof. The embodiments depicted are presented by way of example and are not intended as limitations upon the present invention. Thus, those of ordinary skill in this art should understand that the present invention is not limited to these embodiments since modifications can be made. Therefore, it is contemplated that any and all such embodiments are included in the present invention as may fall within the scope and spirit thereof.

What is claimed:

1. A wrench, said wrench comprising:

a. a handle;

b. a head connected to the handle, the head having:
- a top surface,
- a bottom surface, and
- a generally cylindrical bore formed from the top surface to the bottom surface, the bore generally having a first radius that defines an inner circumferential surface;

c. a generally cylindrical rotor at least partially received within the bore, the generally cylindrical rotor having
- a first portion defining
  - a plurality of spaced-apart rotor teeth formed axially on an outer circumference thereof,
  - a second radius defined from a center of the rotor to the tips of the rotor teeth, and
  - a first cavity formed axially in the first portion,
- a second portion defining
  - a third radius, defined from the rotor center to an outer circumference of the second portion, that is larger than both the first and the second radii, and
  - a second cavity formed axially in the second portion,
- a web separating the first and second cavities, and
- at least one magnet received within the web such that a portion of the at least one magnet is adjacent each rotor cavity,
- wherein
  - the first and second cavities are configured to engage a workpiece, and
  - the first portion is received within the generally cylindrical head bore and the second portion is adjacent to the wrench head top surface;

d. a plurality of teeth formed on the bore inner circumferential surface and projecting radially inward, the plurality of teeth each having a first surface having a first height and second opposite surface having a second height, the plurality of spaced-apart rotor teeth being configured to engage the plurality of bore teeth,
- wherein
  - movement of the head in a first rotational direction engages at least one of the plurality of bore teeth with at least one of the plurality of rotor teeth thereby transmitting torque to the workpiece;
  - movement of the head in a second opposite rotational direction allows the plurality of rotor teeth to ratchet over the plurality of bore teeth;
  - each bore tooth first surface extends substantially parallel to a plane that intersects the center of the head bore and each bore tooth second surface is angled with respect to the plane to allow the plurality of rotor teeth to ratchet over the plurality of bore teeth second surfaces; and
  - the plurality of bore teeth are arranged sequentially on the circumferential surface, the height of the last tooth first surface being about one half of the height of the first tooth first surface and any teeth therebetween decreasing in first surface height proportionately from the first tooth to the last tooth.

2. The wrench as in claim 1, wherein the rotor second portion defines a flange adjacent the wrench head top surface, the flange having a frictional outer edge surface.

3. The wrench as in claim 1, the web further comprising a generally cylindrical central bore therethrough and wherein the magnet is generally cylindrical and press-fitted into the generally cylindrical central bore.

4. The wrench as in claim 1, further comprising a leaf spring retained within the body bore, the leaf spring positioned to urge the rotor teeth into engagement with the plurality of teeth.

5. The wrench as in claim 1, the rotor further comprising a groove formed on an outer circumference thereon and a ring received in the groove.

6. The wrench as in claim 1, wherein a portion of the rotor outer circumference defines a gripping surface.

* * * * *